United States Patent [19]

Atwood et al.

[11] 4,317,316

[45] Mar. 2, 1982

[54] TRUSS

[75] Inventors: Eldon W. Atwood; Alfred E. Johnson, both of Cardston, Canada

[73] Assignee: Dandi Products Limited, West Lethbridge, Canada

[21] Appl. No.: 35,007

[22] Filed: May 1, 1979

[30] Foreign Application Priority Data

Jun. 13, 1978 [CA] Canada ..... 305332

[51] Int. Cl.[3] ..... E04B 7/02

[52] U.S. Cl. ..... 52/93; 52/642

[58] Field of Search ..... 52/639, 642, 643, 93, 52/691, 692, 693, 644

[56] References Cited

U.S. PATENT DOCUMENTS

| | | | |
|---|---|---|---|
| 2,390,180 | 12/1945 | Sahlberg . | |
| 2,461,916 | 2/1949 | Omar . | |
| 2,549,816 | 4/1951 | Johnson | 52/642 X |
| 2,881,878 | 4/1959 | Erickson . | |
| 3,067,544 | 12/1962 | Willutts | 52/691 X |
| 3,343,321 | 9/1967 | Axelsson | 52/296 |
| 3,345,792 | 10/1967 | Chandler | 52/643 X |

FOREIGN PATENT DOCUMENTS

| | | | |
|---|---|---|---|
| 490947 | 7/1919 | France | 52/639 |
| 330736 | 6/1958 | Switzerland | 52/642 |

*Primary Examiner*—Price C. Faw, Jr.
*Assistant Examiner*—Carl D. Friedman
*Attorney, Agent, or Firm*—Smart & Biggar

[57] ABSTRACT

The specification discloses a truss having first and second wall columns and first and second roof elements. Knee braces connect the wall columns intermediate their ends with the roof portions intermediate their ends. A center cord spans the roof sections, the latter comprising pairs of stacked wooden elements arranged vertically edge to edge bridging the point at which the knee braces join the roof elements and the point at which the center cord joins the roof elements. The construction minimizes costs and wastage of materials, and uses standard commercially available lumber while providing for adequate strength.

5 Claims, 2 Drawing Figures

TRUSS

Figures 1, 1A:
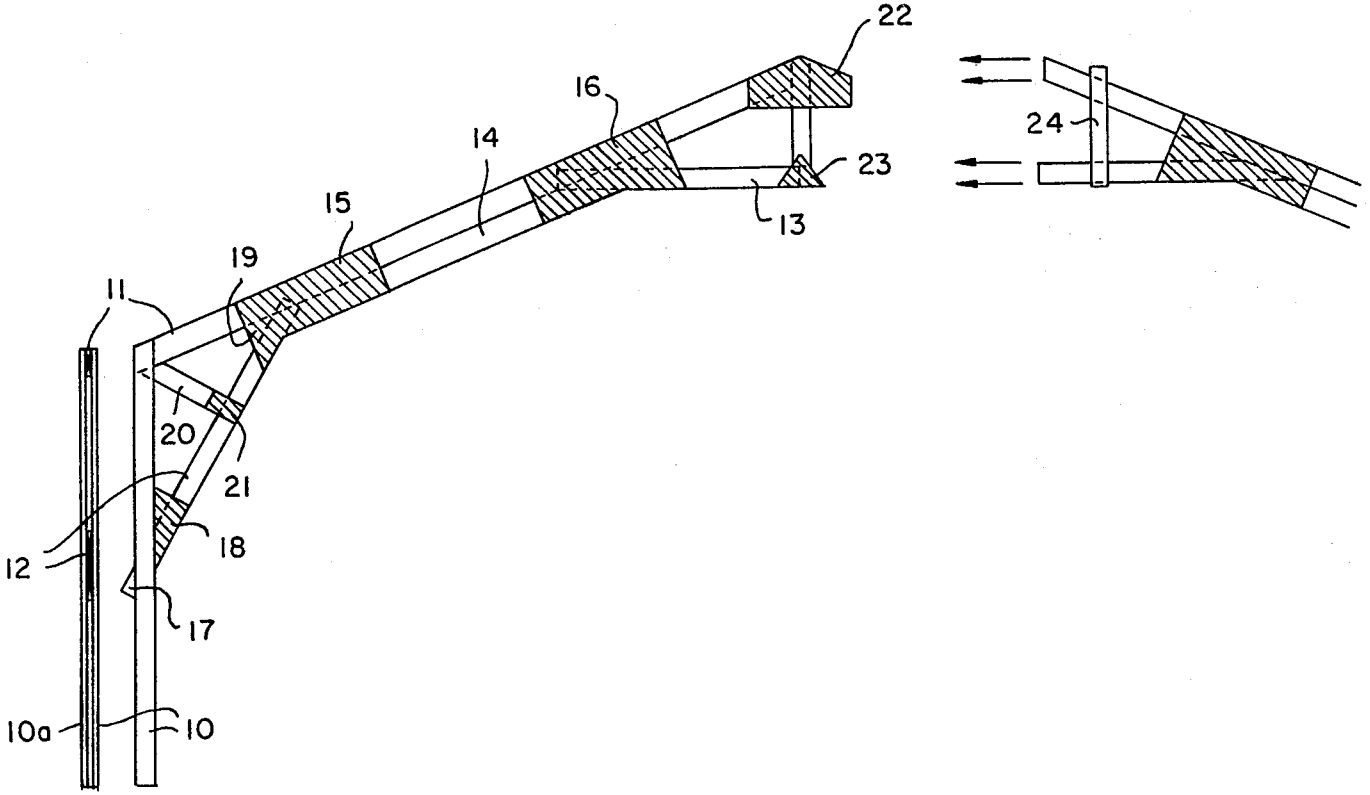

This invention relates to trusses, and specifically to trusses of the type that include a wall column.

The design and construction of trusses has in recent years advanced substantially, it having been realized that the construction of elements of a building in a factory with the subsequent assembly of these elements on site materially reduces the cost of construction.

It is also known to construct building elements comprising one wall column and a half of a roof portion, two of these elements being assembled in the field to form what is known as a three hinged arch. Normally such arches are secured at two points to spaced foundations, and the third point constitutes the center of the roof, with a plurality of such elements being formed into the frame of a building.

Much of the prior art, however, it concerned with structures that are difficult and expensive to construct and it is accordingly an object of this invention to provide a combination wall and roof truss that can be prefabricated in a factory and assembled on site, using standard materials in an economical fashion while providing for maximum utilization of space within the building.

The invention accordingly comprises a truss having first and second wall columns, first and second roof elements, knee braces connecting the wall columns intermediate their ends with the roof portions intermediate their ends, a center cord spanning the roof sections, said roof section each comprising at least a pair of stacked wooden elements arranged vertically edge to edge and bridging the point at which the knee braces join said roof elements and the point at which said center cord joins the roof elements.

The above construction provides ample head room within a building while minimizing the use of expensive materials. The stacking of the center cords permits the use of standard sizes of inexpensive lumber while providing adequate strength.

It is preferred that the wall elements comprise two individual pieces of lumber sandwiching the ends of the roof elements and the knee braces. It is also preferred that plywood be used in forming gussets for attaching the several elements together, using standard nailing patterns for securing the various elements together. As required the plywood can be replaced by steel "gang" nails of the type well known in the art.

A preferred embodiment of the invention will now be described by reference to the accompanying drawings, in which:

FIG. 1 is a schematic illustration of a truss structure manufactured according to the invention; and FIG. 1*a* is an end elevation of a portion of the wall member.

Referring to the drawings, there is shown a wall member comprising wooden elements, for example constructed of two inch by six inch lumber. These wall elements, identified as 10 and 10*a* in the drawings, sandwich between them at the upper end a roof member 11, and intermediate the ends of the wall elements the knee brace 12. A center cord 13 spans the roof elements 11 as indicated. Between the point at which the knee brace joins the roof element 11 and the point at which the center cord 13 joins the roof element 11, an extra wooden element 14 is provided. The two elements 11 and 14, the center cord 13 and the knee brace 12 are sandwiched between plywood gussets 15 and 16 which, it will be noticed, extend over the joint between the knee brace 12 and the roof element 11 and a substantial distance along the stacked roof elements 11 and 14. Similarly, the gusset 16 extends to a substantial distance on both sides of the point at which the center cord 13 joins the roof element 16. By this means bending and shear loads occuring at the respective joints are taken up by the gussets so as to minimize deflection of the roof as a whole.

It will be noted that at the point where the knee brace joins the wall elements 10 plywood gussets 18 are provided to reduce the tendency of the knee brace to pass between the wall elements where it is loaded in shear. To strengthen the joint between the knee brace and the wall elements, waste material 17 is cut off and transferred to a point between the two gussets 18 adjacent wall elements 10 and 10*a*. The same technique is followed at the upper end of the knee brace; waste material is transferred to the point identified at 19 to fill the space between the gussets 15 and again the gusset 16 is reinforced by waste material cut off from the end of the center cord 13. In addition to nailing the gussets to the various structural elements, gluing is preferably used to add strength to the structure.

An additional element 20 may bridge the point at which the wall element 10 and the roof element 11 join and the center of the knee brace 12. A gusset 21 may also be provided to strengthen the joint between the knee brace 12 and the element 20.

As shown in the drawings, the left hand side and the right hand side of the truss are assembled at the plant in two separate halves, with center gussets 22 and 23 nailed to the left hand side of the split truss. Apart from the gussets 22 and 23 the right hand side of the truss element is identical to the left side and the two halves are brought together on site by the workmen who are to erect a building and after suitable glue is interposed between the gussets and the right hand side of the truss the gussets may be nailed to the truss and allowed to set whereafter the completed truss can be assembled. As shown, the temporary support 24 is attached to the right hand side and is removed after the complete truss is assembled. Alternatively, the entire truss comprising the left hand and right hand sides can be assembled at the factory and transferred to site where it can be erected. This would be desirable in cases where due to local requirements steel gang nails are to be used in place of the plywood elements.

Shown in phantom between the knee brace 12 and the gusset 16 is cut pattern for a four foot by eight foot plywood sheet which will maximize utilization of the plywood sheet so as to minimize wastage. It will be noted that almost all of a four foot by eight foot sheet of plywood can be used to fabricate a single truss, the only wastage being a small portion amounting to a fraction of the sheet.

Modifications to the aforementioned structure can be made. For example, the knee brace 12 can be an external tension type knee brace in which case extension of the roof elements will be required, with the lower roof element 14 being extended at least as far as the wall elements 10. Also, it is possible in certain applications to dispense with the center cord 13 which again will necessitate extension of the roof element 14 as far as the center of the truss.

The embodiments of the invention in which an exclusive property or privilege is claimed are defined as follows:

1. A truss for building construction comprising first and second wall columns, a first roof element connected to said first column and a second roof element connected to said second column, knee braces connecting each wall column intermediate its ends with the connected roof elements intermediate their ends, a center cord interconnecting said roof elements, said roof elements each being secured by means including an extra wooden element arranged vertically edge-to-edge with respect to said roof elements and bridging the point at which the knee braces join said roof elements and the point at which said center cord joins the roof elements.

2. The truss defined in claim 1 wherein the wall columns each comprise a pair of wooden elements sandwiching between them the ends of the roof elements and the lower ends of the knee braces.

3. The truss defined in claim 1 wherein all joints between the several section are reinforced by plywood gussets glued and nailed in place.

4. The truss defined in claim 1 or 2 or 3 wherein the first wall column and the first roof element are constructed separately from the second wall column and the second roof element whereby the two separate units so formed may be assembled on site.

5. The combination defined in claim 1 or 2 or 3 wherein waste material cut off from the ends of the lumber used in construction of the several elements is used for reinforcing the joints.

* * * * *